United States Patent [19]

Clayton et al.

[11] 4,204,391

[45] May 27, 1980

[54] OPEN END SPINNING MACHINE FRAME CONSTRUCTION

[75] Inventors: James W. B. Clayton, Accrington; Douglas O. Clough, Rossendale, both of England

[73] Assignee: Platt Saco Lowell Limited, Helmshore, England

[21] Appl. No.: 911,657

[22] Filed: May 31, 1978

[30] Foreign Application Priority Data

Jun. 2, 1977 [GB] United Kingdom ..... 23332/77

[51] Int. Cl.[2] ..... D01H 1/16; D01H 1/12

[52] U.S. Cl. ..... 57/1 R; 57/58.89

[58] Field of Search ..... 57/1 R, 56, 58.89–58.95

[56] References Cited

U.S. PATENT DOCUMENTS

| | | | |
|---|---|---|---|
| 3,075,341 | 1/1963 | Latus | 57/1 R |
| 3,511,045 | 5/1970 | Bures et al. | 57/58.95 X |
| 3,774,382 | 11/1973 | Bartling | 57/1 R |
| 3,782,095 | 1/1974 | Bures et al. | 57/58.89 X |
| 3,936,995 | 2/1976 | Laflaquiere et al. | 57/1 R |
| 3,977,168 | 8/1976 | Schewe | 57/58.89 X |
| 3,990,219 | 11/1976 | Schewe | 57/58.89 X |

*Primary Examiner*—John Petrakes

*Attorney, Agent, or Firm*—Donald H. Feldman

[57] ABSTRACT

A frame construction for an open-end spinning machine includes an elongate plate extending along one side of the machine for supporting a first series of spinning unit housings and an elongate plate extending along the other side of the machine for supporting a second series of spinning unit housings. The plates are interconnected by transverse cross-members, which, preferably, do not project beyond the upper and lower extremities of the plates. Apertures equally spaced along the plates serve to receive and support the spinning unit housings.

The plates are provided along their upper extremities with inwardly projecting flanges which abut against the cross-members so as to locate the plates.

Preferably, the driving elements for the spinning elements supported by the spinning unit housings, and the suction ducts serving to provide vacuum at each of the spinning units are located between and within the upper and lower extremities of the plates.

7 Claims, 3 Drawing Figures

OPEN END SPINNING MACHINE FRAME CONSTRUCTION

BACKGROUND OF THE INVENTION

This invention relates to textile machines which produce yarns by the open-end spinning method and particularly to a frame construction for such machines.

In one hitherto known open-end spinning machine frame construction as described in U.S. Pat. No. 3,977,168 the main frame comprises a series of rigid rectangular, tubular members connected in end-to-end relationship between the end housings which contain the mechanical driving and pneumatic sources for the various spinning elements. Mounted on each of the vertical sides of the main frame are several brackets provided with upper and lower supporting surfaces. The upper surfaces of the bracket supports a beam extending along the machine to which are attached a plurality of yarn winding units. The lower surface of the bracket supports a further beam extending along the machine in which are housed the rotor bearing and driving elements and to which are attached a plurality of spinning unit housings.

A disadvantage of the aforementioned frame construction is the many components involved, each of which will require a machining operation. The necessity to carry out a large number of machining operations is economically undesirable as well as providing a source for errors. Furthermore, such a frame construction does not provide the optimum conditions for machine assembly, nor is it conducive to a desirable compact arrangement of the various elements of the machine.

In British Pat. No. 1,387,867 an open-end spinning machine has a frame construction comprising of a series of hollow rectangular casings extending along each side of the machine so as to support the spinning units. Interposed between the adjacent end surfaces of the casings is a bulkhead to which the casings are attached and which extends transversely of the machine so as to support the casings on each side of the machine. In order to permit passage of the components required for driving the spinning elements, the bulkheads are provided with apertures in alignment with the interior of the casings. Extending centrally along the machine between the casings is a vacuum duct which communicates with each rotor chamber so as to create a subatmospheric pressure therein.

Such a frame construction does not provide a compact assembly and the provision of separate casings for each side of the machine complicates manufacturing procedures by entailing excessive machining operations which detract from the economic aspect of the machine.

In British Pat. No. 1,345,993, and particularly referring to FIG. 5 thereof, the bearings and driving components serving the spinning elements on both sides of the machine are housed in a common casing. The chambers for the spinning rotors are formed in housings defining the sides of the casing and which are integral with the base of the casing. This design results in a very complicated configuration for the casing which, in practice, is exceedingly difficult to manufacture.

SUMMARY OF THE INVENTION

It is an object of this invention to provide a frame construction for an open-end spinning machine, which, by reducing the number of frame component machining operations, is economical to manufacture; facilitates machine assembly, and which permits a compact arrangement of the various elements of the machine.

The foregoing object of the invention is achieved by providing an open-end spinning machine comprising a first spinning unit supporting member extending along one side of the machine for supporting a first series of spinning unit housings, a second spinning unit supporting member extending along the other side of the machine for supporting a second series of spinning unit housings, the first and second spinning unit supporting members each comprising a vertical, substantially planar, elongate plate, each of the plates defining a plurality of apertures for receiving and supporting therein the first and second series of spinning unit housings, and a plurality of cross-members extending between the plates and transverse thereto so as to interconnect the plates at spaced intervals along the length of the plates.

The spinning unit supporting members each have parallel upper and lower extremities and the cross-members do not project beyond the upper and lower extremities.

Preferably the plates each have a flange at the upper extremity thereof for assisting location of the plate on the cross members.

According to a preferred embodiment driving elements are provided for driving the spinning elements supported by the spinning unit housing, wherein said driving elements are located between the plates and within the upper and lower extremities thereof.

Preferably the frame further includes a suction duct extending along the machine communicating with each of the spinning units, wherein said suction duct is located between the plates and within the upper and lower extremities thereof.

Preferably the suction duct communicates with each of a plurality of spinning rotor chambers provided in the spinning unit housings, wherein said frame includes a further suction duct extending along the machine and communicating with each of a plurality of trash collection chambers associated with the spinning units, wherein said further suction duct is located between the plates and within the upper and lower extremities thereof.

DESCRIPTION OF THE PREFERRED EMBODIMENT

Figure 1:
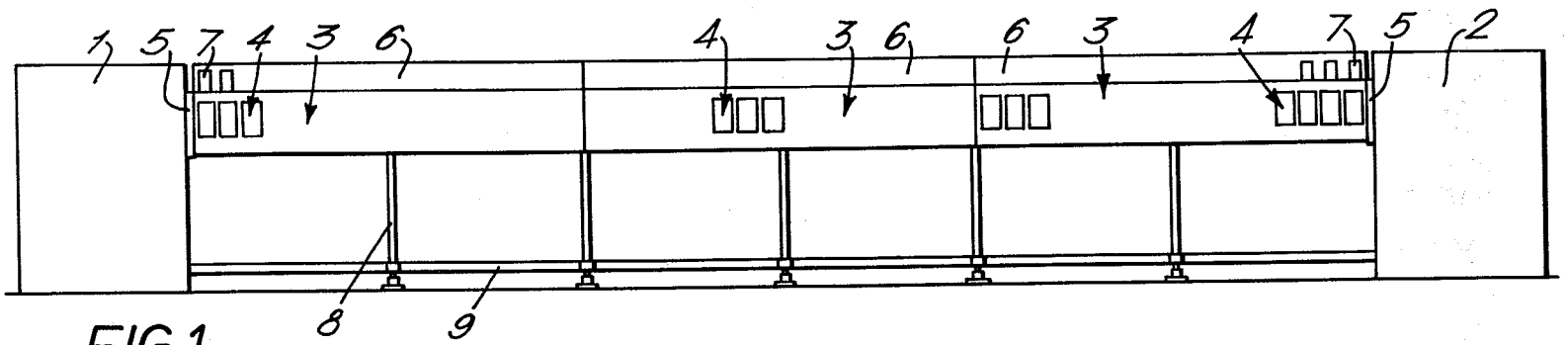
FIG. 1 is a diagrammatic front elevation of an open-end spinning machine frame according to the invention.

With reference firstly to FIG. 1, in which the spinning elements have not been indicated in order more clearly to show the frame construction, two end housings 1, 2 serve to contain the primary mechanical driving and suction sources for the various spinning elements. Extending between the end housings 1, 2 is a series of main frames 3 which support on each side thereof a plurality of spinning units 4. The main frames 3 are connected together in end-to-end relationship to form a continuous beam between the end housings 1, 2. The ends of the main frames adjacent to the end housings 1, 2 are connected thereto by means of spacer members 5. Mounted on top of each of the main frames 3 at each side thereof is a beam 6 on which are supported components of a plurality of winding units 7 as will later be described.

The main frames 3 receive further support from legs 8 of which there is one at each connection of the main frames 3 and one at a position midway between the ends thereof. The rigidity of the machine is enhanced by the provision of longitudinal tie beams 9 interconnecting legs 8.

Three main frames 3 have been shown in FIG. 1, but it should be appreciated that only one such frame may be required, or any number thereof consistent with the practical requirements of a particular installation.

Figure 2:
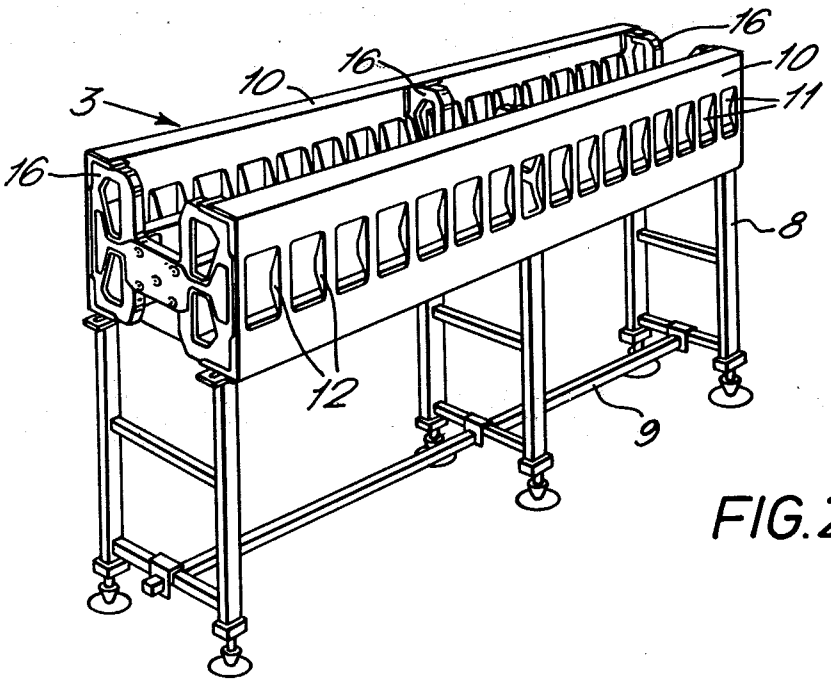
FIG. 2 is an isometric elevation of an intermediate frame section of the machine frame shown in FIG. 1.
Figure 3:
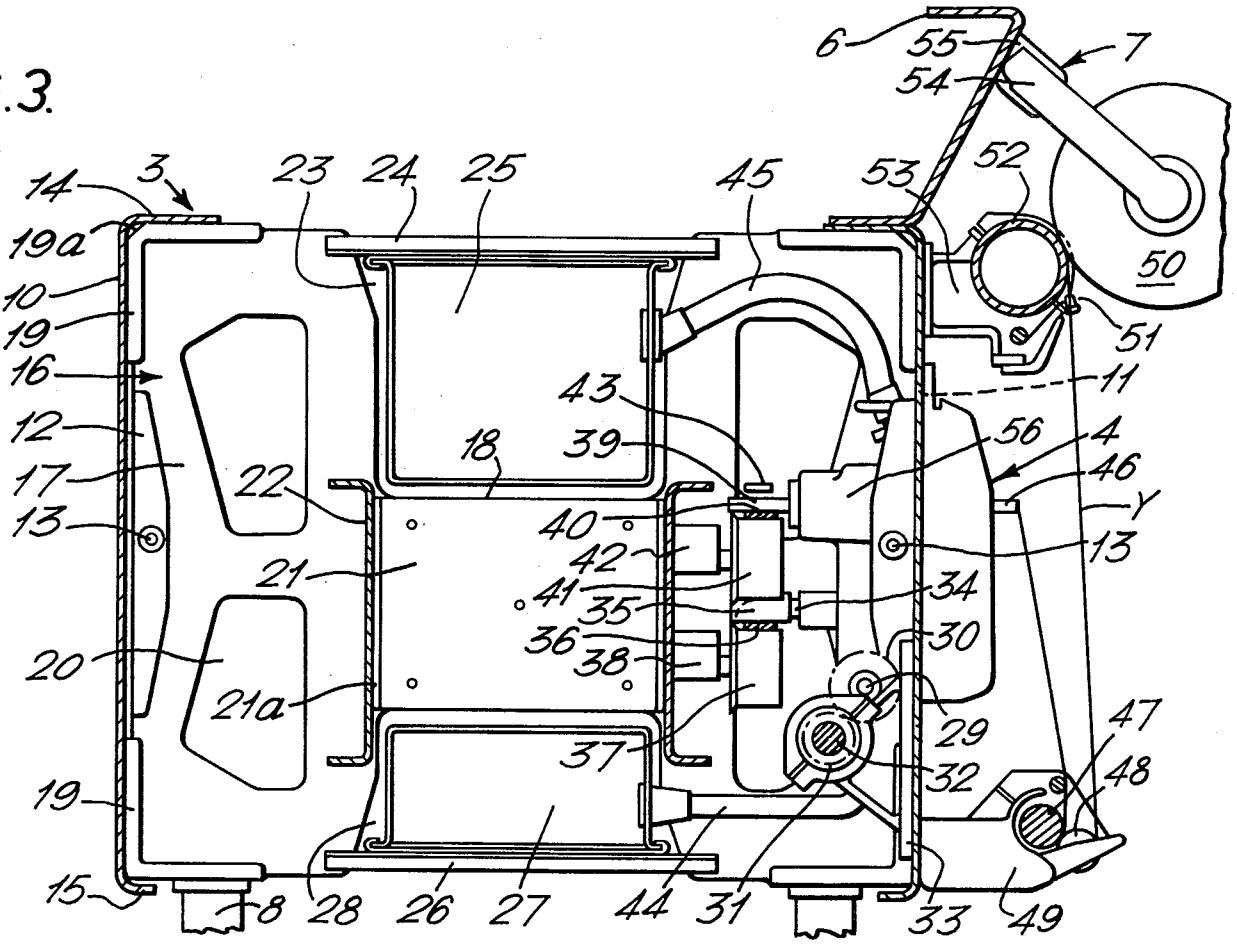
FIG. 3 is a cross-sectional elevation through a main frame section of the machine shown in FIG. 1 showing the components of a spinning station at one side only.

The construction of the main frames 3 can be more clearly seen by reference to FIGS. 2 and 3.

Each main frame 3 comprises a longitudinal unit supporting plate 10 extending along each side of the machine. The plates 10 are each formed from a single flat sheet of metal having parallel upper and lower surfaces and lie in a vertical plane and are provided with a plurality of rectangular apertures 11 at equally spaced positions therealong. At each side of each aperture 11 is an inwardly directed rib member 12 provided with a fulcrum pin 13 which serves to pivotally support a spinning unit housing 56. At the upper end of the plates 10 an upper, inwardly directed flange 14 is formed, and at the lower end is formed an inwardly directed lower flange 15 which define the parallel upper and lower extremities of the plate 10.

The plates 10 are interconnected and spaced apart by cross members 16 of which there is one at each end of the main frame 3 and one mid-way along the length thereof. The cross-members 16 comprise an H-section web constituted by two upright side portions 17 interconnected by a cross-portion 18. At each corner of each of the cross members is an integral machined corner portion 19, which extends by a small amount on each side of the web, on which the plates are located. The upper flanges 14 overlie and are fixed to the top surfaces of the corner portions 19 and the vertical inner surfaces of the plates 10 abut against and are fixed to the outwardly facing vertical surfaces of the corner portions 19. In order to permit satisfactory seating of the plates 10 on the cross-member 16 a chamfered portion 19*a* is formed on the two upper corner portions 19. The lower flange 15 of each plate 10 is spaced below and underlies the lower corner portions 19. Thus the cross-members 16 do not project beyond the upper and lower extremities of the plate 10. Provided in each of the web side portions 17 are two openings constituted by upper and lower irregular pentagonal shaped cut outs 20 which permit passage therethrough of the driving elements for the spinning components as hereinafter described.

Fixed to the inwardly facing surface of the portion 18 of the two end cross members 16 and on each side of the portion 18 of the cross-member 16 intermediate the two ends are brackets 21. Each bracket 21 has two flanges 21*a* extending outwardly from the cross-members 16 and to which are attached longitudinal channels 22 extending along each side of the machine. The channels 22 extend between each of the brackets 21 thus enhancing the rigidity of the main frame and serving to support some of the driving elements as hereinafter described.

Extending between the side portions 17 at an upper position thereof so as to bridge the upper recesses indicated at 23 formed in each cross-member 16 is a top girder 24. Suspended from each of the girders 24 so as to pass through the upper recesses 23 is a longitudinally arranged suction duct 25. Similarly a bottom girder 26 extends between the side portions 17 at a bottom position thereof upon which is supported a trash collection suction duct 27 which passes through the lower recesses, indicated at 28, formed in each cross member 16.

As seen in FIG. 3 the main frame 3 is supported by a pair of legs 8 each of which is fixed to a respective one of the cross-members 16 at the lower horizontal surfaces of its corner portions 19.

The housing 56 is pivotally supported on the fulcrum pin 13 so as to be located within the aperture 11. Supported by the housing 56 at a lower part thereof and within the confines of the main frame 3 is a feed roller countershaft 29 drivingly connected to a feed roller (not shown) which rotates within the housing 56. A driven gear wheel 30 is mounted upon the countershaft 29 and is in driving connection with a driving gear wheel 31 fixed to a drive shaft 32 extending along the machine and passing through the cut-outs 20 so as to provide a drive to the feed rollers at the remaining stations. Support for the drive shaft 32 is provided by a plurality of brackets 33 fixed to the inside surface of the plates 10.

Rotatably supported by the housing 56 towards the lower region thereof is an opening roller shaft 34 at the front end of which is fixed an opening roller (not shown) to rotate within the housing 56. On the rear end of shaft 34 is mounted a driving pulley 35 drivingly connected to a drive belt 36 which extends along the machine through the cut-outs 20 and serves to drive the opening rollers at the remaining spinning stations. Jockey pulleys 37, resiliently mounted in brackets 38 fixed to the channels 22, are biased so as to maintain driving contact between the drive belt 36 and the driving pulley 35 during the spinning operation.

A spinning rotor shaft 39 is rotatably mounted at an upper region of the housing 56 and has fixed on its front end a spinning rotor (not shown) for rotation within a chamber (not shown) formed in the housing 56. The rear end of the rotor shaft 39 protrudes through the rear of the housing 56 so as to be drivingly engaged by a driving belt 40 extending along the machine through the cut-outs 20 to provide a drive to the rotors at the remaining spinning stations.

Jockey pulleys 41, resiliently mounted in brackets 42 fixed to the channels 22, are biased so as to maintain driving contact between the driving belt 40 and the rotor shaft 39 during the spinning operation. Positioned above the rotor shaft 39 is a brake block 43 which is engaged by the shaft 39 when the housing 56 is pivoted on the fulcrum pin 13 from the operative position as shown in FIG. 3 to an inoperative position in which the driving connections between the pulley 35, and driving belt 36 and between the shaft 39 and driving belt 40 are broken.

A flexible pipe 44 communicates with a trash collection chamber (not shown) provided in the housing 56 so as to convey therefrom trash ejected from the opening roller to the trash suction duct 27. A flexible pipe 45 extends between the spinning rotor chamber (not shown) provided in the housing and the suction duct 25. During the spinning operation a vacuum is created within the suction duct 25 in order to create a fibre conveying airstream between the opening roller and the spinning rotor.

The yarn Y produced in the spinning rotor is removed therefrom through a yarn doffing tube 46 by a pair of delivery rollers 47, 48 mounted below the spinning unit 4 and supported by brackets 49 fixed to the plates 10 at spaced intervals therealong. The yarn Y then travels in an upward direction to the winding unit 7 positioned above the spinning unit 4 to be distributed on a package 50 by a reciprocating traverse guide 51. The package 50 is rotated by a package driving roller 52 extending along the machine supported by brackets 53 fixed to the plates 10 at spaced intervals therealong. The package 50 is supported by a pair of arms 54 cantilever mounted in supports 55 fixed to the beam 6 at each spinning station. The beams 6 are attached to the upper flanges 14 of the plates 10.

Preferably, the ends of the feed roller drive shaft 32, the delivery roller 47, the package driving roller 52 and the ends of the suction ducts 25, 27 terminate at a position co-incident with the ends of the machine frame 3. Thus it is possible to pre-assemble a frame 3 with its associated spinning units 4, winding units 7 and the driving elements therefor as a complete unit. The pre-assembled unit can then be delivered to the spinning mill and connected in end-to-end relationship with the other units so as to assemble the open-end spinning machine. Since very little further assembly work is required on site, machine erection is greatly facilitated.

The frame construction as described above provides a very compact arrangement. The driving elements for the feed rollers, opening rollers, and spinning rotors along each side of the machine, together with the two suction ducts one of which is required for developing suction within the rotor spinning chamber and the other for connection to the trash removal chambers can be contained within the upper portion of the main frame 3. These items are situated between the plates 10 extending along each side of the machine and also within the upper and lower extremities of these plates i.e. between boundaries defined by the upper flange 14 and the lower flange 15.

The machine frame 3 is of fabricated construction and thus avoids the casting and machining of large components having complicated sections. Any machining to be carried out on the machine frame 3 is required only on relatively small items and so manufacture of the machine is conducive to mass production techniques.

We claim:

1. In a frame construction for an open-end spinning machine for supporting a plurality of spinning units and their drive and servicing components along each of the two longitudinal sides of said machine, the improvement comprising first and second spinning unit supporting members, each comprising a vertically disposed substantially planar elongate plate formed with a plurality of apertures spaced therealong for receiving and supporting therein a like plurality of spinning units, wherein each plate has an inwardly projecting flange at the upper extremity thereof, said plate being defined between said flange extremity and a lower extremity parallel thereto, and a plurality of cross members, each extending transversely between and rigidly interconnected to said supporting members in such manner as to be wholely contained between said upper and lower extremities, and being formed with and defining a recess therethrough suitable for receiving and supporting a suction duct extending parallel to said supporting members.

2. The improvement as in claim 1, wherein said cross members each are formed with a plurality of said recesses for receiving and supporting a like plurality of said ducts.

3. The improvement as in claim 2, wherein said recesses comprise an upper and a lower recess formed such that said ducts supported thereby are wholely contained between said upper and lower extremities of said supporting members.

4. The improvement as in claim 1, wherein said lower parallel extremity also is defined by an inwardly projecting flange.

5. The improvement as in claim 1, wherein a plurality of brackets are mounted upon said plate, brackets for supporting yarn delivery rollers being mounted below said apertures and brackets for supporting yarn package driving rollers being mounted above said apertures.

6. The improvement as in claim 1, wherein each plate also has an inwardly projecting flange at the lower extremity thereof, each of said flanges both upper and lower abutting said cross-members so as to locate the plates.

7. The improvement as in claim 1, wherein a pair of legs is provided for each of the cross-members whereby to support the frame off the floor.

* * * * *